United States Patent [19]

Stettner et al.

[11] Patent Number: 5,004,162

[45] Date of Patent: Apr. 2, 1991

[54] SOLENOID ACTUATED VALVE ASSEMBLY

[75] Inventors: Ernest R. Stettner, Spencerport; Donald D. Stoltman, Henrietta, both of N.Y.

[73] Assignee: General Motors Corporation, Detroit, Mich.

[21] Appl. No.: 369,506

[22] Filed: Jun. 21, 1989

[51] Int. Cl.[5] ..... F02M 61/04

[52] U.S. Cl. ..... 239/585; 137/605; 137/870

[58] Field of Search ..... 239/585; 137/892, 605, 137/870

[56] References Cited

U.S. PATENT DOCUMENTS

| | | | |
|---|---|---|---|
| 4,572,436 | 2/1986 | Stettner et al. | 239/585 |
| 4,759,335 | 7/1988 | Ragg et al. | 123/531 |
| 4,771,754 | 9/1988 | Reinke | 123/533 |

FOREIGN PATENT DOCUMENTS 8807628 10/1988 PCT Int'l Appl. .

*Primary Examiner*—Andres Kashnikow
*Assistant Examiner*—William Grant
*Attorney, Agent, or Firm*—C. K. Veenstra

[57] ABSTRACT

In an injector adapted to deliver a charge of fuel and air directly into the combustion chamber of a two-stroke cycle engine, a single solenoid coil has an armature mechanism that sequentially opens both a fuel metering valve and a charge delivery valve.

9 Claims, 4 Drawing Sheets

SOLENOID ACTUATED VALVE ASSEMBLY

TECHNICAL FIELD

This invention relates to a solenoid actuated valve assembly suitable for use as an injector adapted to deliver a charge of fuel and air directly into an engine combustion chamber.

BACKGROUND

U.S. Pat. No. 4,759,335, issued July 26, 1988 in the names of P. W. Ragg, M. L. McKay and R. S. Brooks, shows an injector that delivers a fuel-air charge directly into the combustion chamber of a two-stroke cycle engine. The injector has a valve that meters fuel into the injector where the fuel mixes with air to form a fuel-air charge, and another valve that delivers the fuel-air charge into the engine. Separate solenoids actuate the valves in sequence.

SUMMARY OF THE INVENTION

This invention provides a valve assembly in which a single solenoid coil sequentially actuates both a fuel metering valve and a charge delivery valve.

In a solenoid actuated valve assembly according to this invention, a single solenoid coil has an armature mechanism that serves as or otherwise controls two valves. For example, the armature mechanism may open one valve in response to energization of the coil by a low current and both valves in response to a high current.

The armature mechanism in a solenoid actuated valve assembly according to this invention may have a pair of armatures, one of which opens a valve in response to a low current and both of which open valves in response to a high current. Alternatively, the armature mechanism may have a single armature that opens one valve in response to a low current, and two valves in response to a high current.

In one injector employing this invention, a single solenoid coil has one armature that serves as a fuel metering valve and another armature that mechanically operates a charge delivery valve. When the coil is energized with a low current, the fuel metering valve is opened to meter fuel into the injector where the fuel mixes with air to form a fuel-air charge; when the coil is energized with a high current the charge valve is also opened to deliver the fuel-air charge into the engine. In such an injector, the charge delivery valve may include a pintle configuration adapted to create the desired spray characteristics.

In another injector employing this invention, a single solenoid coil has one armature that serves as a fuel metering valve and another armature that directly serves as a charge delivery valve. When the coil is energized with a low current, the fuel metering valve is opened to meter fuel into the injector where the fuel mixes with air to form a fuel-air charge; when the coil is energized with a high current the charge delivery valve is also opened to deliver the fuel-air charge into the engine. In such an injector, the fuel-air charge may be delivered from the charge delivery valve through a nozzle having a poppet valve adapted to create the desired spray characteristics.

In yet another injector employing this invention, a single solenoid coil has a single armature, one portion of which serves as a fuel metering valve and another portion of which serves as a charge delivery valve. When the coil is energized with a low current, the fuel metering valve is opened to meter fuel into the injector where the fuel mixes with air to form a fuel-air charge; when the coil is energized with a high current the charge valve is also opened to deliver the fuel-air charge into the engine. In this injector also, the fuel-air charge may be delivered from the charge delivery valve through a nozzle having a poppet valve adapted to create the desired spray characteristics.

The details as well as other features and advantages of several injectors employing this invention are set forth in the remainder of the specification and are shown in the accompanying drawings.

THE PREFERRED EMBODIMENTS

Figure 1:
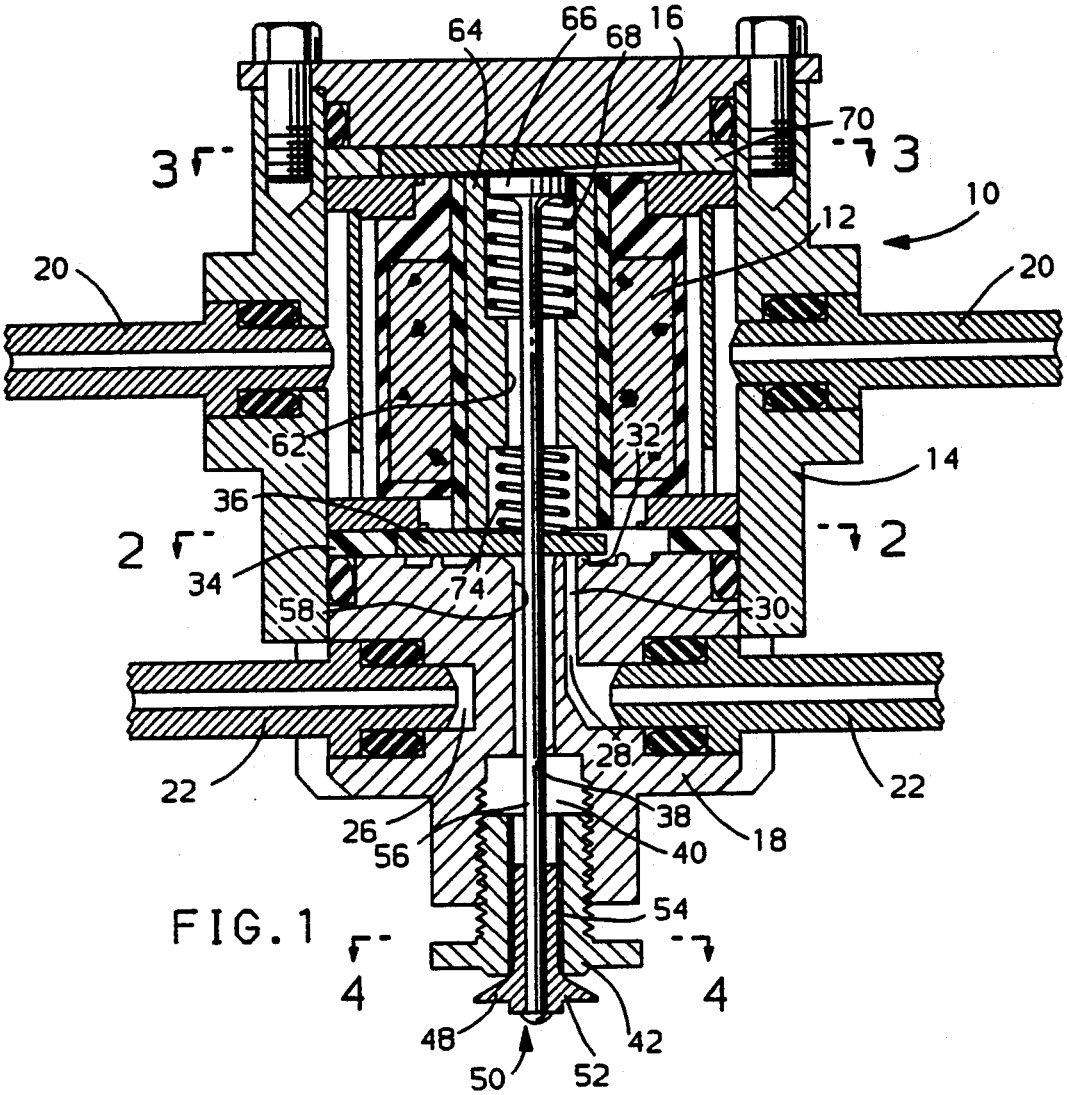
FIG. 1 is an axial sectional view of one injector employing this invention, having a lower armature that serves directly as a fuel metering valve and an upper armature that operates a charge delivery pintle/valve.
Figure 2:
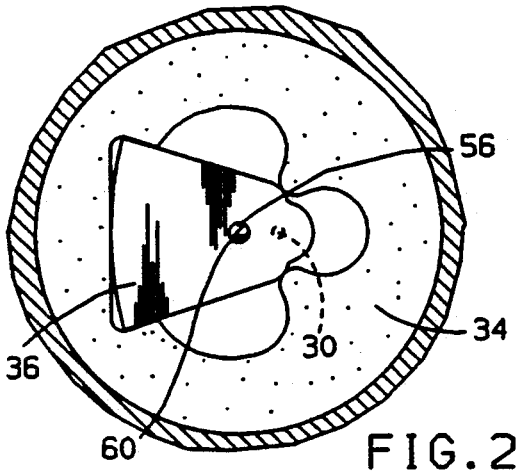
FIG. 2 is a transverse sectional view of the FIG. 1 injector, taken along line 2—2 of FIG. 1, showing the armature that serves as a fuel metering valve.
Figure 3:
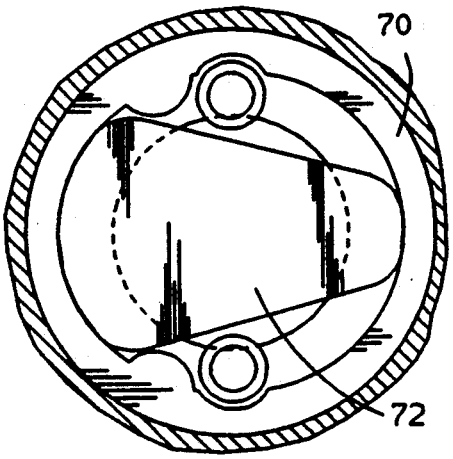
FIG. 3 is a transverse sectional view of the FIG. 1 injector, taken along line 3—3 of FIG. 1, showing the armature that operates the charge delivery pintle/-valve.
Figure 4:
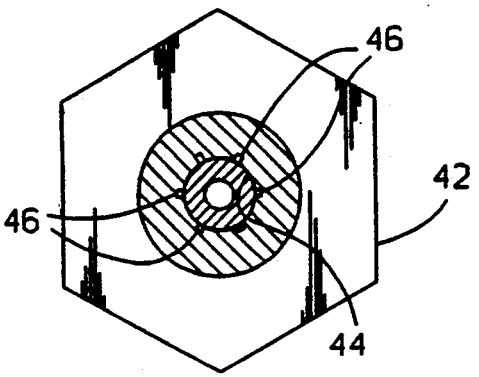
FIG. 4 is a transverse sectional view of the FIG. 1 injector, taken along line 4—4 of FIG. 1, showing the charge delivery nozzle.

Referring first to FIGS. 1-5, an injector 10 has a solenoid coil 12 received within a housing 14 between a cover 16 and a fuel body 18. Inlet fittings 20 provide air at a regulated pressure to housing 14, and inlet fittings 22 provide fuel at a higher pressure to body 18.

Fuel body 18 has an annular recess 26 receiving fuel from one of the fittings 22. A drilled passage 28 in insert 24 opens from recess 26 to a mating drilled passage 30 in fuel body 18. Passage 30 opens through a valve seat 32 into housing 14.

A locator ring 34 is sandwiched between coil 12 and fuel body 18. Ring 34 positions a tapered armature valve member 36 over valve seat 32. Armature valve member 36 may have the attributes set forth in U.S. Pat. No. 4,572,436 issued Feb. 25, 1986 in the names of E. R. Stettner, K. P. Cianfichi and D. D. Stoltman; the disclosure of that patent is incorporated here by reference.

Insert 24 has a central bore 38 with a threaded lower recess 40. A nozzle body 42 is threaded into recess 40. Nozzle body 42 has a central bore 44 with a plurality of axial grooves or flutes 46 spaced around its perimeter. The lower end of nozzle body 42 has a valve seat 48 surrounding bore 44.

A valve member 50 has a head 52 engaging valve seat 48 and a neck 54 guided in bore 44. An operating rod 56 extends from valve member 50 through recess 40, bore 38, a mating bore 58 in fuel body 18, an opening 60 in armature valve member 36, and a bore 62 through the solenoid center pole 64, to a flanged end 66. A spring 68 is engaged between center pole 64 and the flanged end 66 of rod 56 to bias the head 52 of valve member 50 into engagement with valve seat 48.

Another locator ring 70 is sandwiched between coil 12 and cover 16. Ring 70 positions a tapered armature 72 over the flanged end 66 of rod 56. Armature 72 also may have the attributes set forth in U.S. Pat. No. 4,572,436.

A spring 74 is engaged between center pole 64 and armature valve member 36 to bias armature valve member 36 into engagement with valve seat 32.

Figure 6:
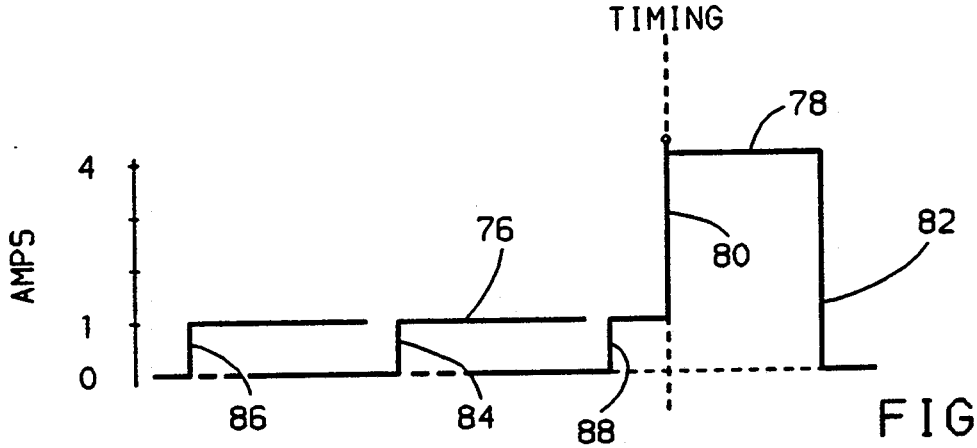
FIG. 6 shows how the current is controlled to energize injectors provided by this invention.

The operation of injector 10 is described with reference to FIG. 6 which shows the current through the coil 12 along the vertical axis and time along the horizontal axis. As solenoid coil 12 is energized with a one ampere current as indicated at 76, armature valve member 36 lifts from seat 32 against the bias of spring 74, while spring 68 holds valve member 50 against seat 48; armature valve member 36 then meters fuel from passage 30 into housing 14 where it mixes with the air to form a fuel-air charge. When the current is increased to four amperes as indicated at 78, armature valve member 36 continues to meter fuel into housing 14, and armature 72 pushes rod 56 against the bias of spring 68 to displace valve member 50 from seat 48; valve member 50 then allows the fuel-air charge to pass through bores 58 and 38, recess 40 and flutes 46 and delivers the fuel-air charge into the combustion chamber of the engine (not shown).

The current is increased from one to four amperes as indicated at 80 to initiate delivery of the fuel-air charge at the appropriate time. The current is maintained at four amperes for the time required to deliver the fuel-air charge. When the current is terminated as indicated at 82, spring 68 causes rod 56 to engage valve member 50 with seat 48 to terminate delivery of the fuel-air charge, and spring 74 engages armature valve member 36 with seat 32 to terminate metering of fuel into housing 14.

The initiation time 84 for the one ampere current is advanced toward 86 when additional fuel is desired, and is retarded toward 88 when less fuel is desired.

When coil 12 is not energized, the magnetic circuit or path has two major axial air gaps at the ends of center pole 64 and two minor axial air gaps between the ring pole 90 and the larger end or heel of each armature 36 and 72. Employing axial air gaps, while minimizing the total air gap, allows low current to lift armature valve member 36. When energized with a low current, armature 36 engages both center pole 64 and ring pole 90, closing the associated major and minor air gaps to increase the flux density at armature 72. Spring 68 opposes movement of armature 72 and valve member 50 in response to the increased flux density until coil 12 is energized with a higher current.

Flutes 46 direct the fuel-air charge between nozzle body 42 and valve neck 54 and out through the opening between valve seat 48 and valve head 52. The size and spacing of flutes 46 and the shape of valve head 52 and valve seat 48 contribute to delivering the fuel-air charge in a desirable spray pattern.

Figure 5:
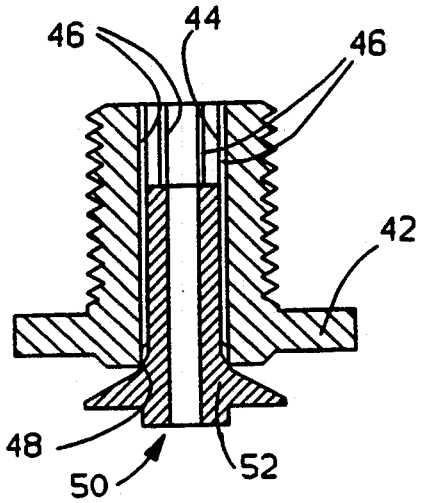
FIG. 5 is an enlarged axial sectional view of the charge delivery pintle/valve and nozzle of the FIG. 1 injector, showing internal flutes that enhance the ability of the injector to deliver the fuel-air charge in a desirable spray pattern.

As shown in FIG. 5, bore 44 opens out to the diameter of flutes 46 near the bottom of bore 44.

Figure 7:
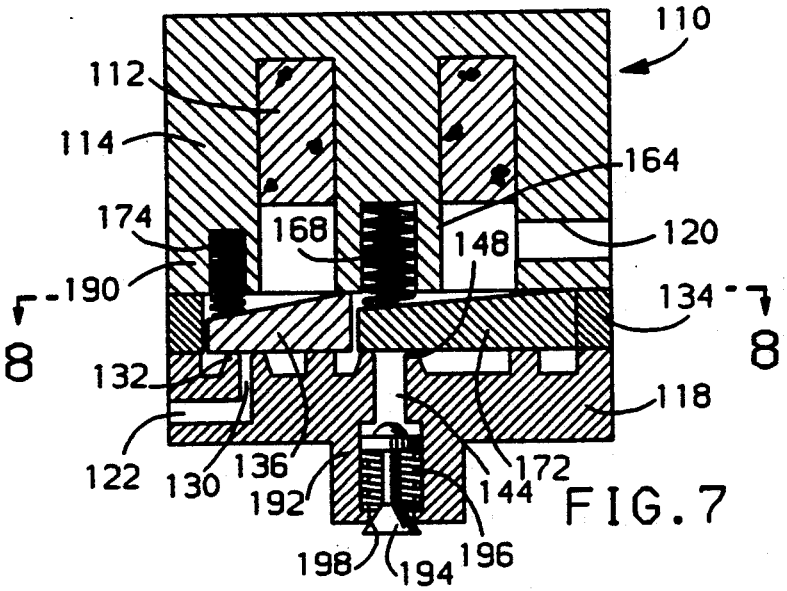
FIG. 7 is a schematic axial sectional view of another injector employing this invention, having one armature that serves as a fuel metering valve and another armature that serves as a charge delivery valve, and also having a poppet valve in the charge delivery nozzle.
Figure 8:
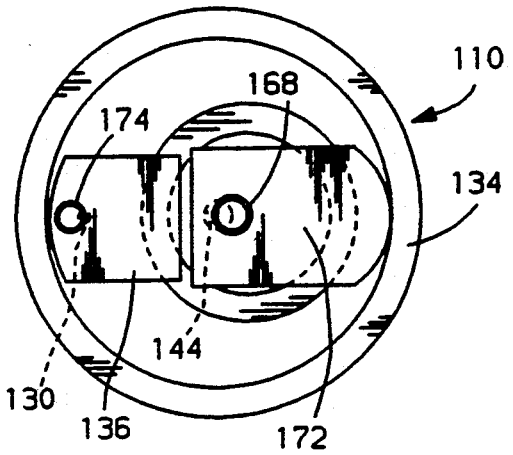
FIG. 8 is a schematic transverse sectional view of the FIG. 7 injector, taken along line 8—8 of FIG. 7, showing the armatures that serve as the fuel metering and charge delivery valves.

Referring to FIGS. 7-8, an injector 110 has a solenoid coil 112 received within a housing 114 that is secured to a fuel body 118. An inlet passage 120 directs air into housing 114, and an inlet passage 122 directs fuel into body 118. A passage 130 in fuel body 118 opens from passage 122 through a valve seat 132 into housing 114.

A locator ring 134 is sandwiched between housing 114 and fuel body 118. Ring 134 positions a tapered armature valve member 136 over valve seat 132. Armature valve member 136 also may have the attributes set forth in U.S. Pat. No. 4,572,436.

Fuel body 118 has a central bore 144, the upper end of which opens into housing 114 and is surrounded by a valve seat 148. Locator ring 134 also positions a tapered armature valve member 172 over valve seat 148. Armature valve member 172 also may have the attributes set forth in U.S. Pat. No. 4,572,436.

A spring 174 is engaged between solenoid ring pole 190 and armature valve member 136 to bias armature valve member 136 into engagement with valve seat 132, and a spring 168 is engaged between solenoid center pole 164 and armature valve member 172 to bias armature valve member 172 into engagement with valve seat 148.

Fuel body 118 has an extension 192 forming a nozzle body. The nozzle body contains a poppet valve member 194 supported in bore 144 and biased by a spring 196 to engage a valve seat 198 surrounding the lower end of bore 144.

The operation of injector 110 is similar to the operation of injector 10. As solenoid coil 112 is energized with a low ampere current, armature valve member 136 lifts from seat 132 against the bias of spring 174, while spring 168 holds armature valve member 172 against seat 148; armature valve member 136 then meters fuel from passage 130 into housing 114 where it mixes with the air to form a fuel-air charge. When the current is increased, armature valve member 136 continues to meter fuel into housing 114, and armature valve member 172 lifts from seat 148; armature valve member 172 then allows the fuel-air charge to pass through bore 144. The fuel-air charge displaces poppet valve member 194 from seat 198 against the bias of spring 196 and is delivered into the combustion chamber of the engine (not shown).

Current is supplied to initiate fuel metering at the appropriate time, and is increased to initiate delivery of the fuel-air charge at the appropriate time. The increased current is maintained for the time required to deliver the fuel-air charge. When the current is terminated, spring 168 engages armature valve member 172 with seat 148 to terminate delivery of the fuel-air charge, and spring 174 engages armature valve member 136 with seat 132 to terminate metering of fuel into housing 114.

Figure 9:
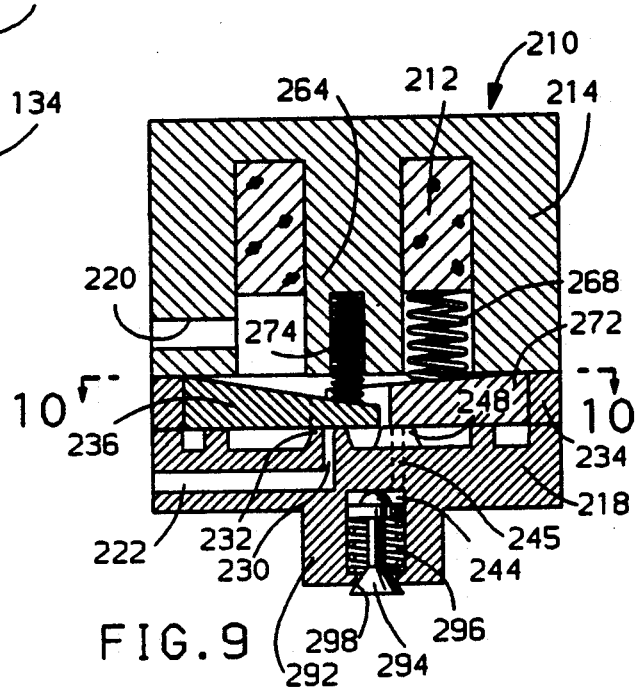
FIG. 9 is a schematic axial sectional view of a third injector employing this invention, similar to the FIG. 7 injector, but in which the fuel metering valve seat is located near the solenoid center pole instead of near the solenoid ring pole.
Figure 10:
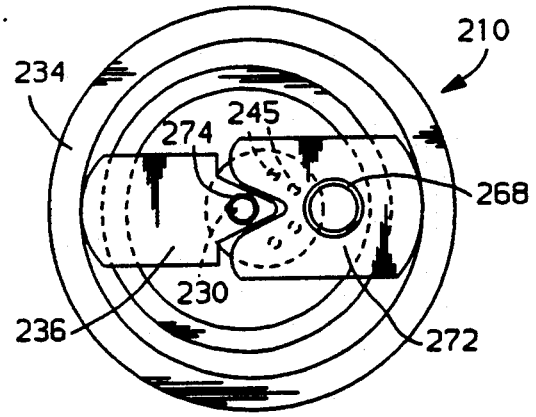
FIG. 10 is a schematic transverse sectional view of the FIG. 9 injector, taken along line 10—10 of FIG. 9, showing the armatures that serve as the fuel metering and charge delivery valves.

Referring to FIGS. 9–10, an injector 210 has a solenoid coil 212 received within a housing 214 that is secured to a fuel body 218. An inlet passage 220 directs air into housing 214, and an inlet passage 222 directs fuel into body 218. A passage 230 in fuel body 218 opens from passage 222 through a valve seat 232 into housing 214.

A locator ring 234 is sandwiched between housing 214 and fuel body 218. Ring 234 positions a tapered armature valve member 236 over valve seat 232. Armature valve member 236 also may have the attributes set forth in U.S. Pat. No. 4,572,436.

Fuel body 218 has a central bore 244, the upper end of which has a plurality of passages 245 opening into housing 214 and surrounded by valve seats 248. Locator ring 234 also positions a tapered armature valve member 272 over valve seats 248. Armature valve member 272 also may have the attributes set forth in U.S. Pat. No. 4,572,436.

A spring 274 is engaged between solenoid center pole 264 and armature valve member 236 to bias armature valve member 236 into engagement with valve seat 232, and a spring 268 is engaged between coil 212 and armature valve member 272 to bias armature valve member 272 into engagement with valve seats 248.

Fuel body 218 has an extension 292 forming a nozzle body. The nozzle body contains a poppet valve member 294 supported in bore 244 and biased by a spring 296 to engage a valve seat 298 surrounding the lower end of bore 244.

The operation of injector 210 is similar to the operation of injectors 10 and 110. As solenoid coil 212 is energized with a low ampere current, armature valve member 236 lifts from seat 232 against the bias of spring 274, while spring 268 holds armature valve member 272 against seats 248; armature valve member 236 then meters fuel from passage 230 into housing 214 where it mixes with the air to form a fuel-air charge. When the current is increased, armature valve member 236 continues to meter fuel into housing 214, and armature valve member 272 lifts from seats 248; armature valve member 272 then allows the fuel-air charge to pass through passages 245 and bore 244. The fuel-air charge displaces poppet valve member 294 from seat 298 against the bias of spring 296 and is delivered into the combustion chamber of the engine (not shown).

Current is supplied at a low level to initiate fuel metering at the appropriate time, and is increased to initiate delivery of the fuel-air charge at the appropriate time. The increased current is maintained for the time required to deliver the fuel-air charge When the current is terminated, spring 268 engages armature valve member 272 with seats 248 to terminate delivery of the fuel-air charge, and spring 274 engages armature valve member 236 with seat 232 to terminate metering of fuel into housing 214.

Figure 11:
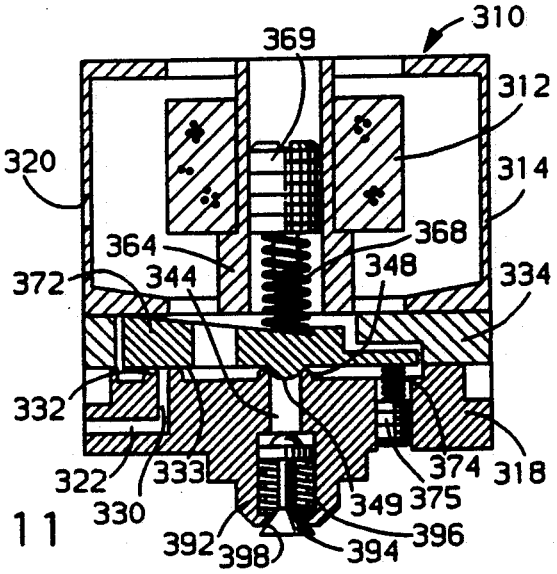
FIG. 11 is a schematic axial sectional view of a fourth injector employing this invention, having one armature that serves both as a fuel metering valve and as a charge delivery valve.

Referring to FIG. 11, an injector 310 has a solenoid coil 312 received within a housing 314 that is secured to a fuel body 318. An inlet 320 directs air into housing 314, and an inlet passage 322 directs fuel into body 318. A passage 330 in fuel body 318 opens from passage 322 through a valve seat 332 into housing 314. A central bore 344 in fuel body 318 opens from housing 314 through a valve seat 348.

A locator ring 334 positions a tapered armature 372 over valve seats 332 and 348. Armature 372 forms a flat valve member 333 associated with valve seat 332 and a rounded valve member 349 associated with valve seat 348. Armature 372 also may have the attributes set forth in U.S. Pat. No. 4,572,436.

A spring 368 is engaged between solenoid center pole 364 and armature 372 to bias valve member 349 into engagement with valve seat 348, and a spring 374 is engaged between fuel body 318 and armature 372 to bias valve member 333 into engagement with valve seat 332.

Fuel body 318 has an extension 392 forming a nozzle body. The nozzle body contains a poppet valve member 394 supported in bore 344 and biased by a spring 396 to engage a valve seat 398 surrounding the lower end of bore 344.

The operation of injector 310 is similar to the operation of injectors 10, 110 and 210. As solenoid coil 312 is energized with a low ampere current, spring 368 holds valve member 349 against seat 348, and armature 372 pivots about valve member 349 to lift valve member 333 from seat 332 against the bias of spring 374. Valve member 333 then meters fuel from passage 330 into housing 314 where it mixes with the air to form a fuel-air charge. When the current is increased, valve member 333 continues to meter fuel into housing 314, and valve member 349 lifts from seat 348; valve member 349 then allows the fuel-air charge to pass through bore 344. The fuel-air charge displaces poppet valve member 394 from seat 398 against the bias of spring 396 and is delivered into the combustion chamber of the engine (not shown).

Current is supplied at a low level to initiate fuel metering at the appropriate time, and is increased to initiate delivery of the fuel-air charge at the appropriate time. The increased current is maintained for the time required to deliver the fuel-air charge. When the current is terminated, spring 368 engages valve member 349 with seat 348 to terminate delivery of the fuel-air charge, and spring 374 engages valve member 333 with seat 332 to terminate metering of fuel into housing 314.

An adjusting screw 369 is provided to calibrate the force of spring 368, and an adjusting screw 375 is provided to calibrate the force of spring 374. Similar adjustments may be provided for the springs in injectors 10, 110 and 210.

Figure 12:
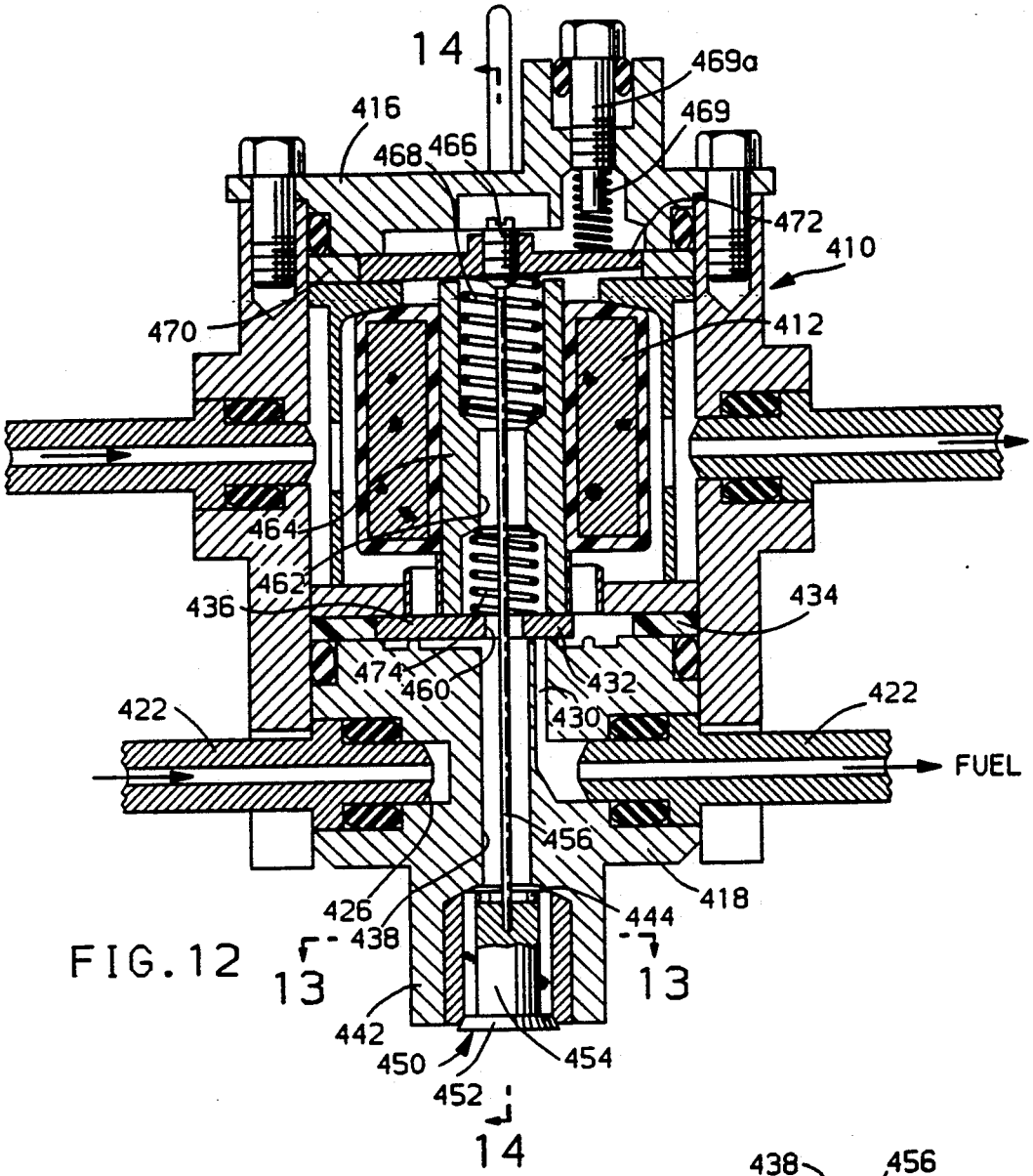
FIG. 12 is an axial sectional view of a fifth injector employing this invention, having a lower armature that serves directly as a fuel metering valve and an upper armature that operates a charge delivery pintle/valve.
Figure 13:
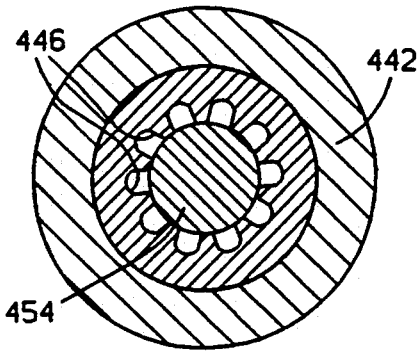
FIG. 13 is a transverse sectional view of the FIG. 12 injector, taken along line 13—13 of FIG. 12, showing the charge delivery nozzle.
Figure 14:
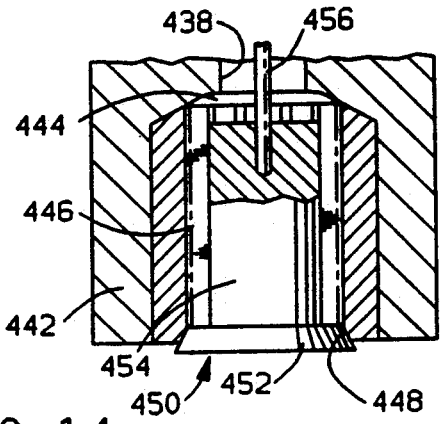
FIG. 14 is an enlarged axial sectional view of the charge delivery pintle/valve and nozzle of the FIG. 12 injector, showing internal flutes that enhance the ability of the injector to deliver the fuel-air charge in a desirable spray pattern.

Referring now to FIGS. 12–14, an injector 410 has a solenoid coil 412 received within a housing 414 between a cover 416 and a fuel body 418. Inlet fittings 420 provide air at a regulated pressure to housing 414, and inlet fittings 422 provide fuel at a higher pressure to body 418.

Fuel body 418 has an annular recess 426 receiving fuel from one of the fittings 422. A drilled passage 430 opens from recess 426 through a valve seat 432 into housing 414.

An armature locator ring 434 is sandwiched between coil 412 and fuel body 418. Ring 434 positions a tapered armature valve member 436 over valve seat 432. Armature valve member 436 may have the attributes set forth in U.S. Pat. No. 4,572,436.

Fuel body 418 has a central bore 438 leading through a nozzle body 442 to an enlarged bore 444. Bore 444 has a plurality of axial grooves or flutes 446 spaced around its perimeter. The lower end of nozzle body 442 has a valve seat 448 surrounding bore 444.

A valve member 450 has a head 452 engaging valve seat 448 and a neck 454 guided in bore 444. An operating rod 456 extends from valve member 450 through bore 438, an opening 460 in armature valve member 436, and a bore 462 through the solenoid center pole 464, to a connection 466 with a tapered armature 472. A spring 468 is engaged between center pole 464 and armature 472 to bias the head 452 of valve member 450 into engagement with valve seat 448.

Another armature locator ring 470 is sandwiched between coil 412 and cover 416 to position armature 472. Armature 72 also may have the attributes set forth in U.S. Pat. No. 4,572,436.

A spring 474 is engaged between center pole 464 and armature valve member 436 to bias armature valve member 436 into engagement with valve seat 432.

As solenoid coil 12 is energized with a low current, armature valve member 436 lifts from seat 432 against the bias of spring 474, while spring 468 holds valve member 450 against seat 448; armature valve member 436 then meters fuel from passage 430 into housing 414 where it mixes with the air to form a fuel-air charge. When the current is increased, armature valve member 436 continues to meter fuel into housing 414, and armature 472 pushes rod 456 against the bias of spring 468 to displace valve member 450 from seat 448; valve member 450 then allows the fuel-air charge to pass through bores 438 and 444 and flutes 446 and delivers the fuel-air charge into the combustion chamber of the engine (not shown).

When the current is terminated, spring 468 causes rod 456 to engage valve member 450 with seat 448 to terminate delivery of the fuel-air charge, and spring 474 engages armature valve member 436 with seat 432 to terminate metering of fuel into housing 414.

A spring 469 engages armature 472 to calibrate the valve closing force exerted by spring 468. The force of spring 469 is adjustable by a screw **469*a***.

Flutes 446 direct the fuel-air charge between nozzle body 442 and valve neck 454 and out through the opening between valve seat 448 and valve head 452. The size and spacing of flutes 446 and the shape of valve head 452 and valve seat 448 contribute to delivering the fuel-air charge in a desirable spray pattern.

As shown in FIG. 14, bore 444 opens out near the bottom of bore 444 so valve seat 448 is larger than the diameter of flutes 446.

We claim:

1. A solenoid actuated valve assembly comprising first and second valve members, first and second valve seats, a first spring biasing the first valve member to engage the first valve seat, a second spring biasing the second valve member to engage the second valve seat, and a solenoid coil, and wherein the first and second valve members include an armature mechanism effective when the coil is energized with a selected current to displace the first valve member from the first valve seat while the second spring maintains the second valve member in engagement with the second valve seat, the armature mechanism being further effective when the coil is energized with a current higher than the selected current to displace both the first valve member from the first valve seat and the second valve member from the second valve seat.

2. A solenoid actuated valve assembly comprising first and second valve members, first and second valve seats, a first spring biasing the first valve member to engage the first valve seat, a second spring biasing the second valve member to engage the second valve seat, and a solenoid coil, wherein the first valve member includes a first armature effective when the coil is energized with a selected current to displace the first valve member from the first valve seat while the second spring maintains the second valve member in engagement with the second valve seat, and wherein the second valve member includes a second armature effective when the coil is energized with a current higher than the selected current to displace the second valve member from the second valve seat.

3. A solenoid actuated valve assembly comprising a first armature defining a first valve member, a second armature defining a second valve member, first and second valve seats, a first spring biasing the first armature to engage the first valve member with the first valve seat, a second spring biasing the second armature to engage the second valve member with the second valve seat, and a solenoid coil, the first armature being effective when the coil is energized with a selected current to displace the first valve member from the first valve seat while the second spring maintains the second valve member in engagement with the second valve seat, and the second armature being effective when the coil is energized with a current higher than the selected current to displace the second valve member from the second valve seat.

4. A solenoid actuated valve assembly comprising a first armature defining a first valve member, a second valve member, first and second valve seats, a first spring biasing the first armature to engage the first valve member with the first valve seat, a second spring biasing the second valve member to engage the second valve seat, a solenoid coil, the first armature being effective when the coil is energized with a selected current to displace the first valve member from the first valve seat while the second spring maintains the second valve member in engagement with the second valve seat, a second armature, and an operating rod connecting the second armature and the second valve member, the second armature being effective when the coil is energized with a current higher than the selected current to displace the operating rod and thereby displace the second valve member from the second valve seat.

5. A solenoid actuated valve assembly comprising first and second valve members, first and second valve seats, a first spring biasing the first valve member to engage the first valve seat, a second spring biasing the second valve member to engage the second valve seat, a solenoid coil, and a single armature effective when the coil is energized with a selected current to displace the first valve member from the first valve seat while the second spring maintains the second valve member in engagement with the second valve seat, the armature being further effective when the coil is energized with a current higher than the selected current to displace both the first valve member from the first valve seat and the second valve member from the second valve seat.

6. A solenoid actuated valve assembly comprising a single armature defining first and second valve members, first and second valve seats, a first spring biasing the armature to engage the first valve member with the first valve seat, a second spring biasing the armature to engage the second valve member with the second valve seat, and a solenoid coil, the armature being effective when the coil is energized with a selected current to displace the first valve member from the first valve seat while the second spring maintains the second valve member in engagement with the second valve seat, the armature being further effective when the coil is energized with a current higher than the selected current to displace both the first valve member from the first valve seat and the second valve member from the second valve seat.

7. An injector for delivering a charge of fuel and air directly into an engine combustion chamber, the injector having an air inlet, a fuel inlet, a valve seat surrounding the fuel inlet, a fuel metering armature defining a fuel metering valve member, a fuel metering valve spring biasing the fuel metering armature to engage the fuel metering valve member with the fuel inlet valve seat, a charge delivery valve seat through which fuel and air are delivered to the engine, a charge delivery valve member, an operating rod extending from the charge delivery valve member, a charge delivery valve spring biasing the operating rod to engage the charge delivery valve member with the charge delivery valve seat, a charge delivery armature, and a solenoid coil, the fuel metering armature being effective when the coil is energized with a selected current to displace the fuel metering valve member from the fuel inlet valve seat while the charge delivery valve spring maintains the charge delivery valve member in engagement with the nozzle body valve seat, the charge delivery armature being effective when the coil is energized with a current higher than the selected current to displace the operating rod and thereby displace the charge delivery valve member from the nozzle body valve seat.

8. An injector for delivering a charge of fuel and air directly into an engine combustion chamber, the injector having an air inlet, a fuel inlet, a valve seat surrounding the fuel inlet, a fuel metering armature defining a fuel metering valve member, a fuel metering valve spring biasing the fuel metering armature to engage the fuel metering valve member with the fuel inlet valve seat, a charge delivery valve seat through which fuel and air are delivered to the engine, a charge delivery armature defining a charge delivery valve member, a charge delivery valve spring biasing the charge delivery armature to engage the charge delivery valve member with the charge delivery valve seat, and a solenoid coil, the fuel metering armature being effective when the coil is energized with a selected current to displace the fuel metering valve member from the fuel inlet valve seat while the charge delivery valve spring maintains the charge delivery valve member in engagement with the nozzle body valve seat, the charge delivery armature being effective when the coil is energized with a current higher than the selected current to displace the charge delivery valve member from the charge delivery valve seat.

9. An injector for delivering a charge of fuel and air directly into an engine combustion chamber, the injector having an air inlet, a fuel inlet, a valve seat surrounding the fuel inlet, an armature defining a fuel metering valve member, a fuel metering valve spring biasing the armature to engage the fuel metering valve member with the fuel inlet valve seat, a charge delivery valve seat through which fuel and air are delivered to the engine, the armature further defining a charge delivery valve member, a charge delivery valve spring biasing the armature to engage the charge delivery valve member with the charge delivery valve seat, and a solenoid coil, the armature being effective when the coil is energized with a selected current to displace the fuel metering valve member from the fuel inlet valve seat while the charge delivery valve spring maintains the charge delivery valve member in engagement with the nozzle body valve seat, the armature being further effective when the coil is energized with a current higher than the selected current to displace the charge delivery valve member from the charge delivery valve seat.

* * * * *